United States Patent [19]

Panzeri

[11] 4,229,908

[45] Oct. 28, 1980

[54] APPARATUS FOR AUTOMATIC JOINT MACHINING IN HEAVILY THICK CYLINDERS

[75] Inventor: Cesare Panzeri, Macherio, Italy

[73] Assignee: Breda Termomeccanica S.p.A., Milan, Italy

[21] Appl. No.: 954,202

[22] Filed: Oct. 24, 1978

[30] Foreign Application Priority Data

Jun. 1, 1978 [IT] Italy ..... 24114 A/78

[51] Int. Cl.[3] ..... B24B 5/40

[52] U.S. Cl. ..... 51/103 R; 51/165.9; 51/165.93; 15/58; 15/104.1 C

[58] Field of Search ..... 15/21 D, 57, 58, 104.1 C; 51/103 R, 165.9, 165.92, 165.93, 227 R, 245, 290, 34 D, 47; 409/143, 165, 166, 189; 228/125

[56] References Cited

U.S. PATENT DOCUMENTS

| | | | |
|---|---|---|---|
| 2,243,405 | 5/1941 | Wine | 51/165.92 |
| 2,558,943 | 7/1951 | Ellison | 51/166 MH |
| 2,558,983 | 7/1951 | Roberts | 15/57 |
| 2,600,481 | 6/1952 | Clyde | 51/166 MH X |
| 2,694,278 | 11/1954 | Anderson | 51/245 |
| 2,828,586 | 4/1958 | List et al | 51/145 R X |
| 3,992,818 | 11/1976 | Clausen | 51/3 |
| 4,094,102 | 6/1978 | Lauze | 51/47 X |

FOREIGN PATENT DOCUMENTS 580077 11/1977 U.S.S.R. ..... 51/103 R

*Primary Examiner*—Gary L. Smith
*Assistant Examiner*—Robert P. Olszewski
*Attorney, Agent, or Firm*—Fleit & Jacobson

[57] ABSTRACT

The apparatus carried by a suitable handling device, and comprising a first base structure attached to the handling device and provided with vertical guides for the sliding of a first carriage, a second base structure attached to said carriage and provided with horizontal guides for the sliding of a second carriage, and an operating head carried by the second carriage through a hydropneumatic device comprising at least one double-acting penumatic cylinder for supporting said head and having its axis vertically arranged, and a hydraulic damper connected between said second carriage and operating head, the lower chamber of the operating head supporting pneumatic cylinder being supplied with a first value of pressure as to cause a fast lifting of said head, while the upper chamber of the pneumatic cylinder is supplied with a value of pressure at a lower level as to annul the upward thrust, at the same time supplying said operating head with a downward operative thrust of a constant value.

6 Claims, 11 Drawing Figures

FIG. 1
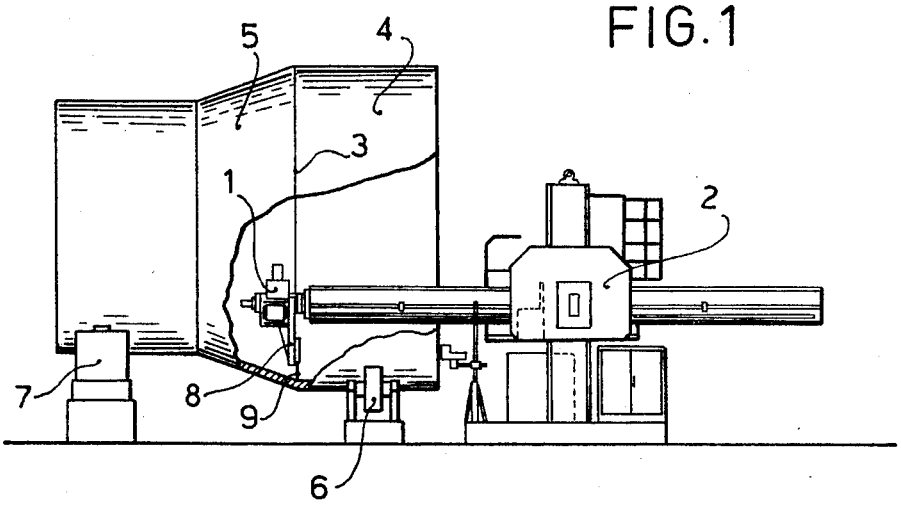
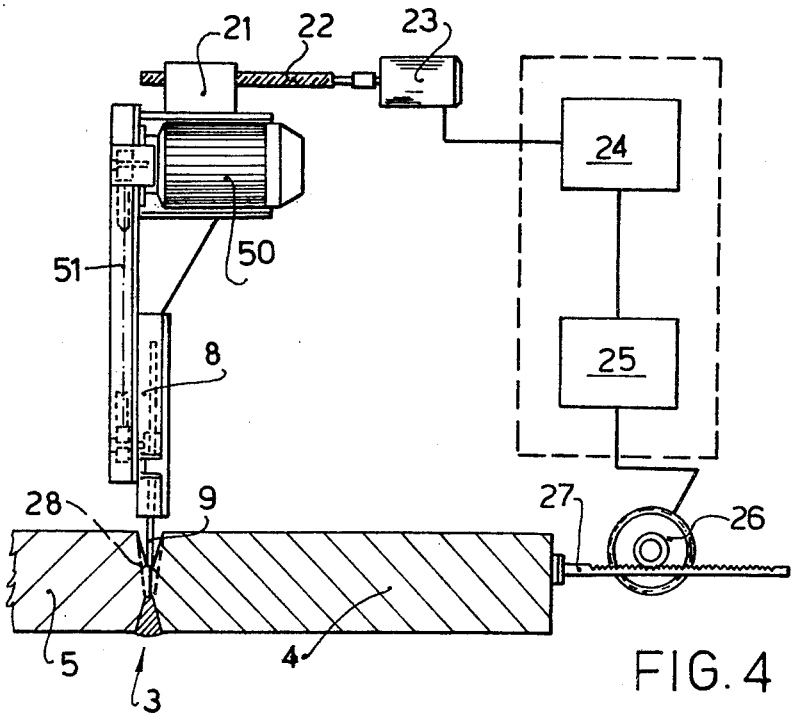
FIG. 4

FIG. 7
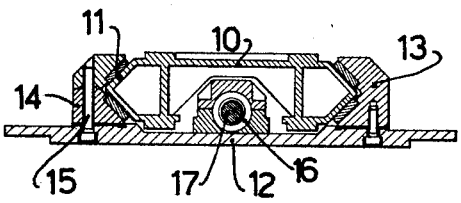
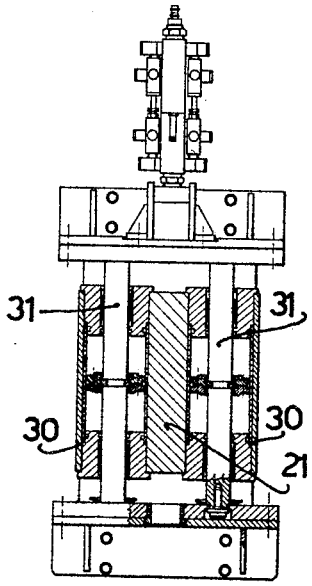
FIG. 8
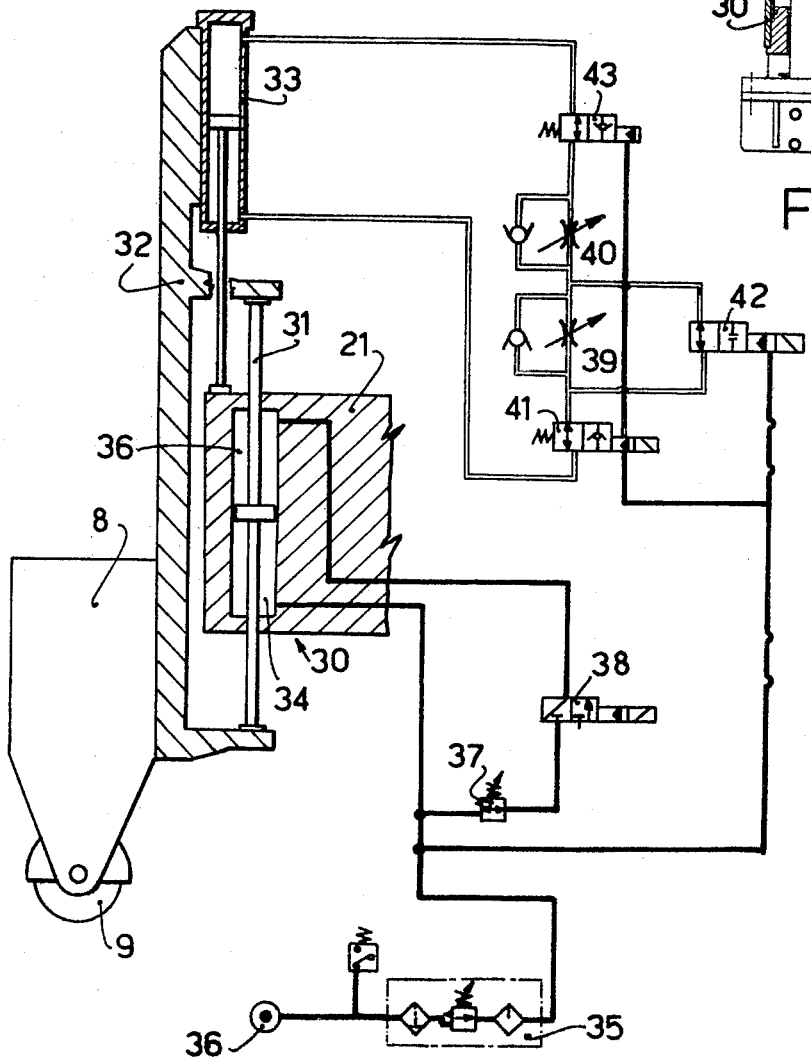
FIG. 9

FIG.10
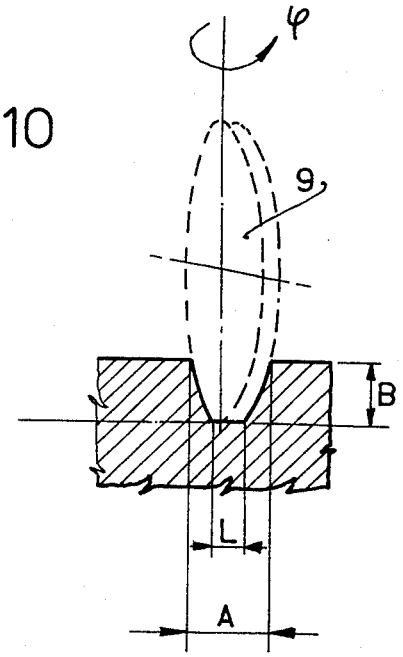
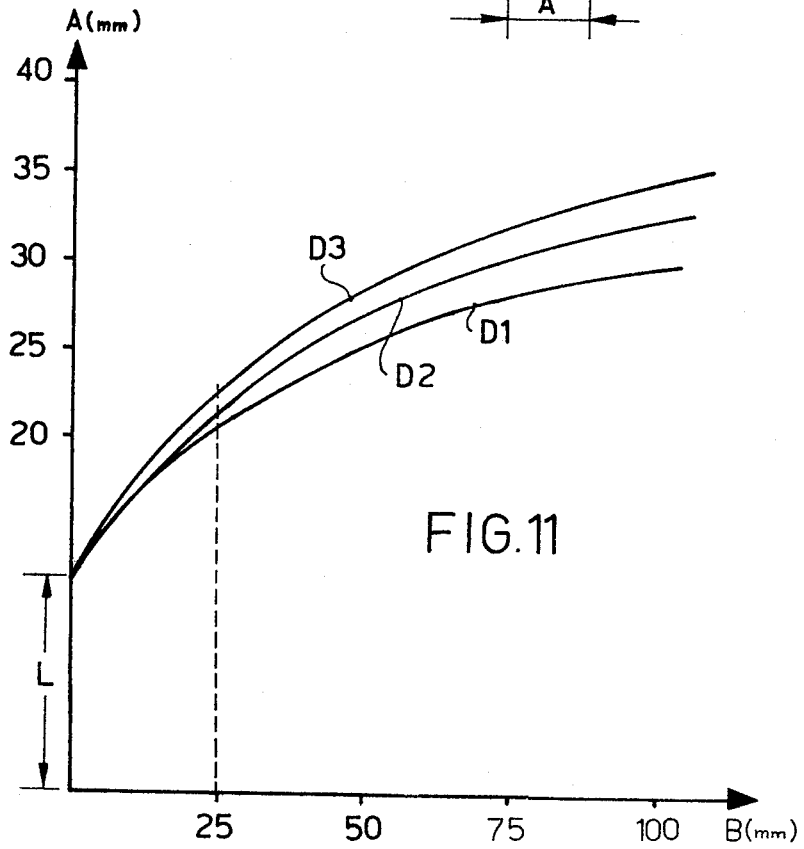
FIG.11

APPARATUS FOR AUTOMATIC JOINT MACHINING IN HEAVILY THICK CYLINDERS

This invention relates to an apparatus for automatic machining of both longitudinal and circumferential joints in heavily thick cylinders; particularly, the invention is directed to an apparatus of the above specified design, by which such operations as grinding, brushing and trimming can be carried out by means of abrasive band during welding of joints in large cylinders normally used for the manufacture of components in oil, chemical, petrochemistry, nuclear industry and the like.

As well known, welding of joints, particularly circumferential joints between heavily thick cylinders, involves a previous machining of the chamfers in the opposing edges of the cylinders, and required shoulders and spigots between the cylinders. After a first welding of the chamfer, such operations should be carried out as chamfer scarfing or spigot removal and low roughness trimming of the surfaces for the necessary check operations prior to next welding pass; it is also required to carry out a final joint trimming operation for the removal of the protruding welds.

The operation of chamfer scarfing or removal of any welding supporting plate is normally carried out by a complex and highly expensive operation by means of an electric arc scarfing head with jet of compressed air. In addition to its complexity, such an operation of chamfer scarfing does not enable the performance of good quality weldings, therefore a good trimming of the welding resumption surfaces is required. The geometry of the chamfer and its surfaces provided after scarfing, have to be successively corrected and trimmed with a long work of manual grinding.

It is the object of the present invention to provide an apparatus of the above mentioned design, by means of which scarfing operations by grinder can be carried out, as well as successive trimming operations, providing a perfect geometry of the chamfer with surfaces that are finished and ready for the next welding pass.

It is another object of the present invention to provide an apparatus of the above mentioned type, wherein the chamfer grinding machining is effected by constant shearing stress.

It is a further object of the present invention to provide an apparatus of the above mentioned type, wherein the working plane of the operating head can be positioned in different ways for suitably varying the section profile of the chamfer obtained.

It is still a further object of the present invention to provide an apparatus of the above mentioned type, by means of which all of said operations required for preparing the welding resumption chamfer can be automatically carried out, thus completely replacing the previously required manual roughing-out and trimming operations, considerably increasing the productivity of the apparatus.

According to the invention, the foregoing can be accomplished by an automatic apparatus for the machining of joints in heavily thick cylinders, which apparatus is carried by a suitable handling device and is characterized by comprising a first base structure attached to the handling device and provided with vertical guides for the sliding movement of a first carriage, a second base structure attached to said carriage and provided with horizontal guides for a sliding movement of a second carriage, and an operating head movably carried by the second carriage through a hydropneumatic device comprising at least one head supporting double-acting pneumatic cylinder having its axis vertically arranged, and a hydraulic damper connected between said second carriage and the operating head, the lower chamber of the pneumatic cylinder supporting the operating head being supplied by a first value of pressure as to cause a fast lifting of said head, while the upper chamber of the pneumatic cylinder is supplied by a second value of pressure lower than the former and such as to compensate the upward thrust, providing the operating head with a downward operative thrust of constant value.

The apparatus for the machining of joints in heavily thick cylinders, according to the present invention, will be more particularly disclosed herein below with reference to the example shown in the accompanying drawings, in which:

FIG. 1 is a general view of the apparatus according to the invention;

FIG. 4 is a diagram showing the servo control for tracking the joint displacements;

FIG. 7 is a sectional view taken along transverse plane 7—7 of FIG. 6;

FIG. 8 is a sectional view taken along vertical plane 8—8 of FIG. 3;

FIG. 9 is a view showing the hydropneumatic scheme for supporting the operating head which is part of the apparatus according to the present invention;

FIG. 10 is a view showing a modified profile for the chamfer as provided by rotating the working plane of the grinder; and FIG. 11 is a graphic showing the characteristics of the chamfer cross-section as the maximum diameter of the grinder varies.

Figure 2:
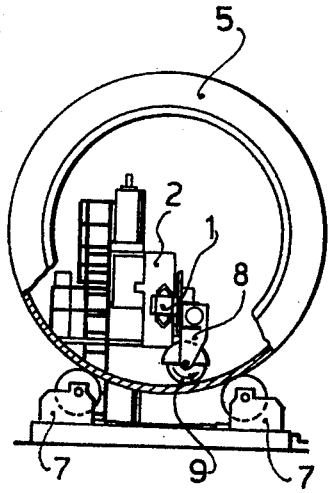
FIG. 2 is an end view of the apparatus shown in FIG. 1.
Figure 5:
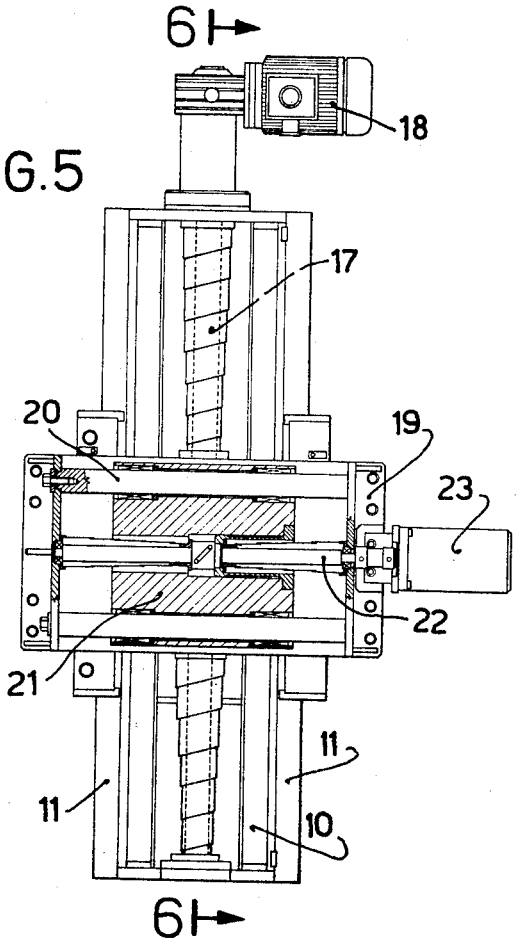
FIG. 5 is a sectional view taken along line 5—5 of FIG. 3.

As shown in FIGS. 1 and 2, the apparatus according to the present invention, designated as a whole at 1, is carried by a handling device 2, for example of the arm type, capable of lifting and moving head 1 to position it at a joint, for example a circumferential welding joint 3 between heavily thick cylinders 4 and 5 which are rotably carried about the longitudinal axis thereof by two sets of rollers 6 and 7, of which one is driven in a per se known manner.

An operating head 8 is carried by apparatus 1 for moving both in vertical and horizontal direction, as hereinafter explained, to position the tool, such as a grinder 9 relative to joint 3, and to follow any side displacements or deformations of the joint due, for example, to a slight ovalization of cylinders 4 and 5.

Figure 3:
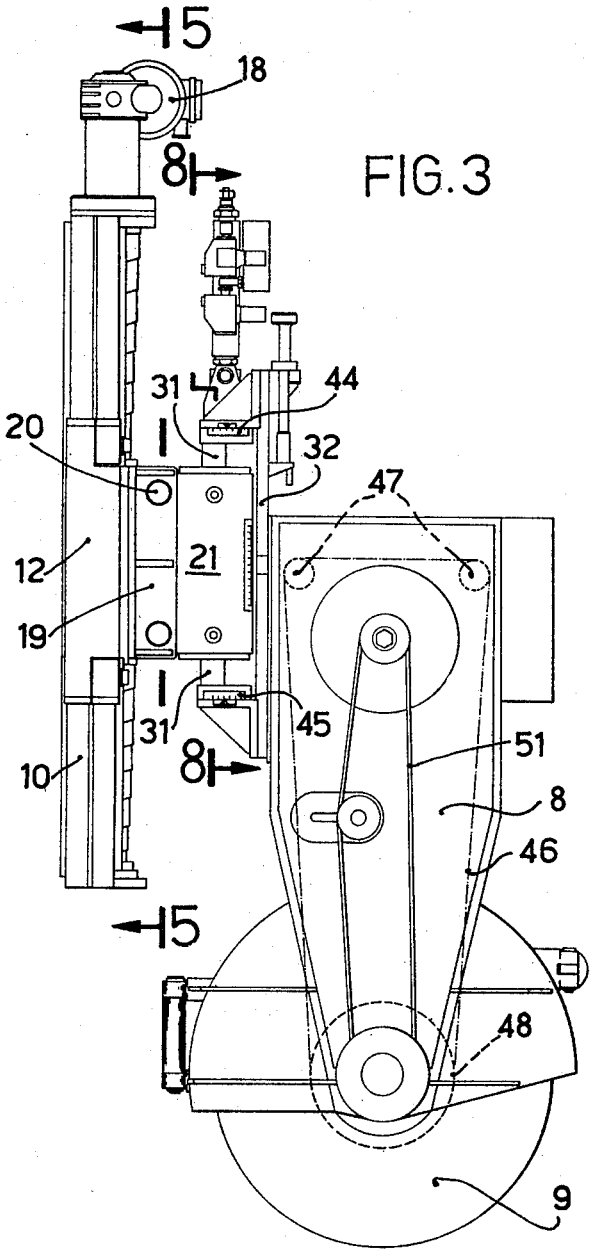
FIG. 3 is an enlarged view of the apparatus shown in FIG. 1.
Figure 6:
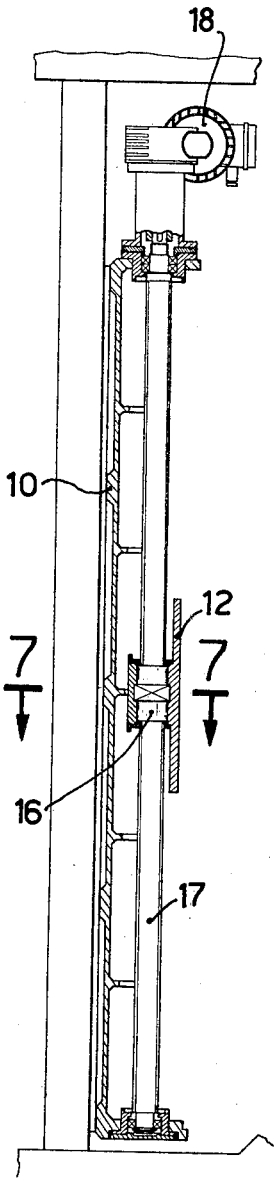
FIG. 6 is a sectional view taken along vertical line 6—6 of FIG. 5.

FIG. 3 is an enlarged view of the apparatus which is now described in detail with reference to the remaining figures.

Particularly, it will be seen from FIGS. 3, 5, 6 and 7 that the apparatus comprises a first base structure 10 for attachment to said handling element or device, which has two prismatic vertical guides 11 parallel to the axis of vertical slide for a first carriage 12, this carriage 12 being provided with sliding blocks 13 and 14 (FIG. 7), of which at least one sliding block 14 is formed of two parts to make up a mechanical clamping device for the carriage against vertical guides 11 by tightening a screw 15.

Carriage 12 is driven along the vertical axis by a nut screw and worm assembly 16, 17 controlled through an electric geared motor 18 for a stroke at constant traversing speed.

Said carriage 12 sliding along said vertical axis has attached thereto a second base structure 19 with two cylindrical guides 20 defining a horizontal axis along which a second carriage 21 can slide, this second carriage 21 carrying through a hydropneumatic device said operating head 8. Said horizontal axis enables a positioning and tracking movement of circumferential joint 3 from said operating head 8 to maintain the tool always and perfectly positioned relative to the joint. Therefore, said carriage 21 is driven, for example, by a ball recirculating screw 22 directly connected to the shaft of an electric stepping motor 23 to perform two distinct functions, namely a first function for positioning the head along the horizontal axis, that is transversely of circumferential joint 3 with a fixed traversing speed, and a second joint self-tracking function during the operation of the operating head. Thus, as shown in the diagram of FIG. 4, stepping motor 23 is driven by a control unit comprising a feeder 24 and pulse translator 25, connected to a linear-angular position transducer 26, such as an "encoder" perceiving through a feeler 27 the displacements of joint 3 parallel to the axis of cylinders 4 and 5. By way of example, it is herein specified that the electronic control unit may be of STM 1800 CW type available from Superior Electric-U.S.A., and stepping motor 23 may be of M 118 F 12 type still available from Superior Electric-U.S.A., having a high static-dynamic strength. Thus, the effect of axial of the cylinders is compensated during, for example, the grinding operation for the spigot removal and forming a new chamfer (shown in phantom in FIG. 4) prior to a new welding pass.

Referring to the figures of the accompanying drawings, and particularly to the diagram of FIG. 9, a description will now be given for the hydropneumatic unit carrying the operating head, allowing the latter to operate with a constant shearing stress.

As above mentioned, the hydropneumatic unit carrying the operating head performs the function of providing the feeding motion with a constant shearing stress for the tool, clamping at vertical position and fast return in upward direction.

In the example shown, said hydropneumatic assembly consists of two double-acting pneumatic cylinders 30 provided or made integral with carriage 21 sliding along the joint tracking horizontal axis. The rods 31 of both said cylinders are rigidly and parallel connected to a third carriage 32 having the above mentioned operating head 8 rigidly attached thereto. As shown in FIG. 8, rods 31 are guided by ball recirculating bushes accomodated within the heads of cylinders 30. This solution brings about a low operation hysterisis and accordingly ensures a good constancy in shearing stress.

Said hydropneumatic assembly carrying head 8 further comprises a hydraulic damper including, for example, a double-acting hydraulic cylinder 33 connected between carriages 21 and 32 (FIG. 9).

Still referring to the diagram of FIG. 9, it will be seen that lower chamber 34 of each pneumatic cylinder 30 is connected through a lubricator-reduction gear-filter assembly 35 to a source of pressure fluid 36 to supply said lower chambers of cylinders 30 with such a first value of pressure as to balance the weight of head 8 and supporting carriage 32, causing a fast movement thereof in upward direction. At the same time, upper chamber 36 of cylinders 30 is supplied through a further pressure reducer 37 and electrovalve 38 with a second value of pressure lower than the former and such as to balance the upward thrust of the head, imparting to the latter a downward operative thrust of constant value. This downward thrust of constant value allows to give a constant value of shearing stress on grinder 9 during grinding operation of the chamfer.

Hydraulic damper 33 has its upper and lower chambers connected in a closed circuit comprising two throttling valves operating in opposite directions, for example of manual control type, as well as pneumatically driven safety valves and electrovalves 41, 42 and 43, which may be suitably operated to enable, in addition to dampening of head vibration, also a smooth and positive control of descending speed of said head with valves 38 and 42 energized, clamping of head at any position through energization of pneumatically driven electrovalve 41, and fast upward return of the head with valves 38, 41 and 42 de-energized.

The apparatus further comprises a capability of angular adjustment of the operating head according to an axis parallel to the vertical sliding axis of the head. Therefore, as shown in FIG. 3, carriage 32 supporting said operating head 8 is directly articulated at 44 and 45 to the two transverse supporting shoulders having said rods 31 of pneumatic cylinders 30 attached thereto. Thus, head 8 can be rotated and clamped by means of screws at an angular position that can be read on a graduated scale, as shown. Under the same conditions for the grinder (constant thickness), said rotation or angular adjustment of the operating head permits to obtain a continuous range of chamfer sections of increasing widths as the grinder angling increases. Thus, the section of the obtainable chamfer only depends on the angle and thickness of the grinder, not being substantially affected by the wear and change in diameter of said grinder. This is shown, for example, by FIGS. 10 and 11, where A designates the maximum width of the chamfer, L the width at the bottom, and B its depth. In FIG. 11, curves $D_1$, $D_2$ and $D_3$ show the changes in the maximum width of the chamfer, as the depth of said chamfer varies, for an angle $\phi=3°$, with $L=12$ mm for diameter of grinders $D_1=400$ mm, $D_2=500$ mm and $D_3=600$ mm, respectively. From said figures it will be seen that for normal values of B about 25 mm, slight changes in A occur as the diameter of the grinder changes; thus, at any time of the machining process, a worn out grinder can be replaced without having to correct the original angular adjustment of the operating head.

Finally, FIG. 3 shows a variant to the apparatus, according to which grinder 9 could be replaced also by a rotary metal brush, or by an abrasive band 46 wrapping up about driving rollers 47 and a rubber-coated roller 48 applied in place of grinder 9, this rubber-coated roller 48 being still controlled through belt drive 51 by electric motor 50 for control of grinder 9 (FIG. 4). The use of said abrasive band is also made convenient by the possibility of angular adjustment for the head plane, as above referred to, since longitudinal welds can be removed with a component of the band feed rate in the direction of the weld, and a still high working or operating speed in transverse direction.

Therefore, from the foregoing and as shown in the accompanying drawings it clearly appears that an apparatus has been provided for the machining of joints for heavily thick cylinders, the apparatus allowing a grinding operation at high shearing rate and constant shearing stress. This affords the highest output by volume of removed material, providing a chamfer of constant depth, the bottom surface of which is perfectly cylindrically machined. The apparatus can be used with excellent results and very short positioning times, even in welding repair operations for removing a faulty weld within a chamfer. The grinding operation of circumferential joints may be also simultaneously carried out with internal or external filling welding, thus allowing a further reduction in time required for carrying out a complete welding.

Such operations as cleaning and polishing of the chamfer are also possible by the use of said apparatus, substituting a rotary metal brush for grinder 9. The operation is carried out by holding the operating head at clamped position and only one revolution of the cylinder would be sufficient for a perfect polishing free of oxide traces and grinding residues. Therefore, it should be understood that the matter above disclosed and shown in the accompanying drawings was given by way of example of the intended general solution of the present invention, and that other variants could be made to the individual parts without departing from the disclosed inventive principle.

What is claim is:

1. An apparatus for the automatic machining of joints in cylinders comprising a handling device, a first base structure attached to said handling device and provided with vertical guides, a first carriage slidable on the said vertical guides, a second base structure attached to said carriage and provided with horizontal guides, a second carriage slidable on said horizontal guides, a hydropneumatic device mounted on said second carriage and comprising at least one double acting pneumatic piston and cylinder assembly and a hydraulic damper, an operating head, and means attaching said operating head to said hydropneumatic device, said attaching means including means for angularly orienting said operating head relative to said second carriage about a vertical axis, said pneumatic piston and cylinder assembly having a lower chamber and an upper chamber, means for supplying said lower chamber with fluid at a first pressure to cause a fast lifting of said head, and means for supplying said upper chamber with fluid at a second pressure lower than said first pressure to annul the upward thrust while supplying said operating head with a downward operative thrust of a constant value.

2. The apparatus as defined in claim 1 including a pair of said double acting pneumatic piston and cylinder assemblies and ball recirculating bushes between the piston rods and cylinder heads of said assemblies.

3. The apparatus as defined in claim 2 wherein said attaching means comprises bracket means attached to the piston rods of said assemblies and a third carriage attached to said operating head and wherein said angular orienting means is connected between said third carriage and said bracket means.

4. The apparatus as defined in claim 1 including control means for said second carriage comprising a stepping motor and a control circuit for said motor connected to a transducer for axial displacement of the joint.

5. The apparatus as defined in claim 1 wherein said hydraulic damper comprises a cylinder having chambers connected in a closed circuit comprising opposing throttling valves.

6. The apparatus as defined in claim 5 including pneumatically driven shuttle valves in said closed circuit.

* * * * *